US006899486B2

(12) United States Patent
Wetzel et al.

(10) Patent No.: US 6,899,486 B2
(45) Date of Patent: May 31, 2005

(54) PEN WITH A SCENTED HOUSING

(76) Inventors: Eric L. Wetzel, 26665 Eureka Rd., Taylor, MI (US) 48180; Jon C. Wetzel, 2600 Greenstone Blvd., Apt. #109, Auburn Hills, MI (US) 48326

( * ) Notice: Subject to any disclaimer, the term of this patent is extended or adjusted under 35 U.S.C. 154(b) by 0 days.

(21) Appl. No.: 10/618,312

(22) Filed: Jul. 14, 2003

(65) Prior Publication Data

US 2004/0028459 A1 Feb. 12, 2004

Related U.S. Application Data

(60) Provisional application No. 60/396,585, filed on Jul. 18, 2002.

(51) Int. Cl.[7] ..... B43K 29/00
(52) U.S. Cl. ..... 401/195; 401/6; 401/209
(58) Field of Search ..... 401/6, 52, 195, 401/209

(56) References Cited

U.S. PATENT DOCUMENTS

| | | | | |
|---|---|---|---|---|
| 1,307,859 A | | 6/1919 | Hugetz | |
| 3,660,055 A | * | 5/1972 | Haller | 44/535 |
| 4,601,598 A | | 7/1986 | Schwartz et al. | |
| 4,678,206 A | * | 7/1987 | Leahan | 401/195 |
| 4,681,471 A | * | 7/1987 | Hayduchok et al. | 401/34 |
| 4,728,212 A | * | 3/1988 | Spector | 401/209 |
| 4,762,493 A | | 8/1988 | Anderson | |
| 5,110,584 A | | 5/1992 | Medri et al. | |
| 5,419,592 A | * | 5/1995 | Stuart | 283/102 |
| 6,169,595 B1 | | 1/2001 | Manne | |
| 6,190,078 B1 | * | 2/2001 | Smith | 401/195 |
| 6,217,242 B1 | | 4/2001 | Cote | |
| 6,273,626 B1 | * | 8/2001 | Yazawa | 401/6 |
| 6,298,263 B1 | | 10/2001 | Sedgwick et al. | |
| 6,334,974 B1 | | 1/2002 | Chen | |

FOREIGN PATENT DOCUMENTS

| | | | |
|---|---|---|---|
| JP | 07290889 A * | 11/1995 | B43K/29/20 |
| JP | 10291396 | 11/1998 | |

OTHER PUBLICATIONS

Catalogue, Geddes–Schools of Raymond Geddes and Company, Baltimore, MD,, 2001.

* cited by examiner

*Primary Examiner*—Tuan Nguyen
(74) *Attorney, Agent, or Firm*—Richard C. Litman

(57) ABSTRACT

A writing pen such as a ballpoint pen having a scented housing or barrel made by including a scented agent (natural or synthetic) into the material (such as plastic) forming the pen housing. In the case of a metal housing or barrel, the pen has a scented coating such as lacquer or enamel. In a preferred embodiment the pen has a grip incorporated into the pen barrel made of a relatively soft, polymeric or rubber material which incorporates a scent giving off the desired aroma. The inventive scented pen is useful as an advertising or other promotional device and includes imprinted advertising, logo or other identification of the source for advertising purposes. The pen has the pleasant aroma of a commercial establishment with which the aroma is associated, such as the aroma of the coffee of a particular coffee house, with the name or logo of the coffee house.

4 Claims, 5 Drawing Sheets

PEN WITH A SCENTED HOUSING

CROSS-REFERENCE TO RELATED APPLICATION

This application claims the benefit of U.S. Provisional Patent Application Ser. No. 60/396,585, filed Jul. 18, 2002.

BACKGROUND OF THE INVENTION

1. Field of the Invention

The present invention relates to writing instruments. More particularly, the present invention relates to a pen having a housing which having a scent which gives off a desired aroma and advertising on the housing related to the particular aroma.

2. Description of the Related Art

Writing instruments such as pens are widely distributed as advertising premiums and for commercial sale. It would be desirable to provide a pen with enhanced advertising properties beyond imprinted matter on the barrel of the pen merely identifying the advertiser or source whether the pen is an advertising premium or sold to a customer in the case of bars, restaurants, event souvenirs, or other establishments or sources with which the customer desires to be identified.

It is known to provide scented pens having scented ink, a scented polymeric grip integral with the pen barrel, and scented polymeric grips which may be pulled over the barrel of a pen or pencil.

U.S. Pat. No. 6,217,242 B1, issued Apr. 17, 20001, to Cote, C. W. E., describes a scented writing implement that has an absorbent pencil soaked in a liquid fragrance.

U.S. Pat. No. 4,762,493, issued Aug. 9, 1988, to Anderson, describes impregnated scented crayons, chalk, and clay, teaching identification of color to scent and scent to color.

U.S. Pat. No. 6,334,974 B1, issued Jan. 1, 2002, to C. Chen, describes a fragrant plastic container fabrication method.

U.S. Pat. No. 5,110,584, issued May 5, 1992, to Medri et al., describes a scented cosmetic enamel for nails.

U.S. Pat. No. 6,169,595 B1, issued Jan. 2, 2001, to Manne describes a device to deliver various combinations of scents in rapid succession to a user's nose in conjunction with video graphic images and/or sounds.

U.S. Pat. No. 6,298,263 B1, issued Oct. 2, 2001, describes a method of odor selection for selecting an odor to match a visual or auditory target stimulus. The subject matter of the '263 patent is related to aromachology as see column 3, lines 10–15, thereof.

U.S. Pat. No. 4,601,598, issued Jul. 22, 1986, to Schwartz et al., describes a finger gripping device useful as a removable attachment to a writing implement.

U.S. Pat. No. 6,273,626 B1 issued Aug. 14, 2001, to Yazawa describes a grip incorporated in the barrel of a writing device such as a pen.

Japanese Patent No. 10-291396, published Apr. 11, 1998, describes a fragrant pen whose purpose is to enhance the efficiency of business or learning according to a psychological effect brought on to the user by fragrance having the effect of encouraging or tranquilizing the user's spirits by sealing perfume in a ballpoint pen and evaporating the perfume at the time of using the pen.

The catalogue of Geddes-Schools of Raymond Geddes and Company, Inc., Baltimore, Md. describes scented pencil grips having aromatherapy attributes.

None of the above inventions and patents, taken either singularly or in combination, is seen to describe the instant invention as claimed. Thus, a pen having enhanced effectiveness as an advertising vehicle by employing a scent is desired.

SUMMARY OF THE INVENTION

The present invention is a writing pen such as a ballpoint pen having a scented housing or barrel. The housing or barrel is made by including a scented agent (natural or synthetic) into the material (such as plastic) forming the pen housing. In the case of a metal housing or barrel, the pen has a scented coating such as lacquer or enamel. In a preferred embodiment the pen has a grip incorporated into the pen barrel made of a relatively soft, polymeric or rubber material which incorporates a scent giving off the desired aroma. The scented pen of the invention is useful as an advertising or other promotional device and includes imprinted advertising, logo or other identification of the source for advertising purposes. The pen has a pleasant aroma which reminds the user of a commercial establishment with which the aroma is associated, such as the aroma of the coffee of a particular coffee house, along with the name or logo of the coffee house. Aromas may also simulate types of coffee preparations such as espresso, latté, cappuccino, and café mocha and other flavored coffees. Of course, other types of foods could be aromatically simulated, such as pizza, hamburgers, tacos, and buttered popcorn, along with imprinted advertising for the particular restaurant or other establishment serving the type of food aromatically simulated. The scent may be a floral scent along with advertising for a particular florist. Many scents can be envisioned having aromas having nexus with a type of commercial establishment which would benefit from the advertising of the services, goods, or products.

As a specialty advertising item, the invention provides different benefits to two categories of advertisers. The first is an advertiser that is promoting a product, service, or overall impression that is scent specific. The advertiser utilizes the invention not only to disseminate identifying and/or contact information about itself (name, logo, address, telephone number, etc.), but to provide a scent that promotes its products, services and the overall impression it wishes to convey. Examples include the scent of coffee for a coffee ship promoting coffee drinks, and a grower, grinder, or supplier promoting coffee beans and grounds; a floral scent for a florist or grower promoting flowers, and a ladies' boutique promoting feminine atmosphere; the scent of vanilla for a bakery promoting baked goods, and a massage therapist promoting aromatherapy or aromachology; perfume for a manufacturer or retailer promoting perfume, and a spa promoting a feminine atmosphere; popcorn for a theater; and chocolate for a candy shop.

The second type of advertiser includes advertisers that do not offer a product or service or promote an overall impression that is scent specific. The presence of a fragrance in the invention allows the advertiser's pen to stand out against other specialty advertising pens. By selecting a generally pleasing scent for its pen, the advertiser is offering an advertising item that its target audience is more likely to use in order to enjoy its aroma. By using the pen more often than other pens, the advertisement on the pen is seen more often. Increased visibility of an ad corresponds to an increase in the advertiser's chances that it leaves an impression on the user, which results in increased business and revenue for the advertiser.

Businesses having a well-known brand or logo, or other identifying mark which motivates the buyer to buy souvenirs, such as bars, restaurants, events, or resorts derives advertising value by providing a scented pen for sale, whether scent specific to the business or of generally pleasing aroma.

The inventive pen is distinguishable from those employing scented ink in ink cartridges in that notes, documents, letters, etc. are not scented by the ink.

Accordingly, it is a principal object of the invention to provide a scented pen, such as a ball point pen, having the scent incorporated in the housing or barrel, a coating material, or a grip incorporated in the barrel, the pen having advertising or a business logo affixed to the pen.

It is another object of the invention to provide a pen as above which has a scent specific aroma associated with a business establishment.

It is another object of the invention to provide a pen as above which is useful as an advertising or promotional device.

It is an object of the invention to provide improved elements and arrangements thereof for the purposes describe which is inexpensive, dependable, and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a writing pen such as a ball point pen with a scented housing or barrel and advertising affixed to the housing, the aroma of which is associated with the advertising. The advertising may typically include the imprinted name of the advertising business and its logo. The housing is made by incorporating a scented agent (natural or synthetic) into the material (such as a plastic) forming the pen housing. In the case of a metal housing, the pen has a scented coating such as lacquer or enamel. A preferred embodiment has a soft, scented, plastic polymeric or rubber grip incorporated into the pen.

Figure 1:
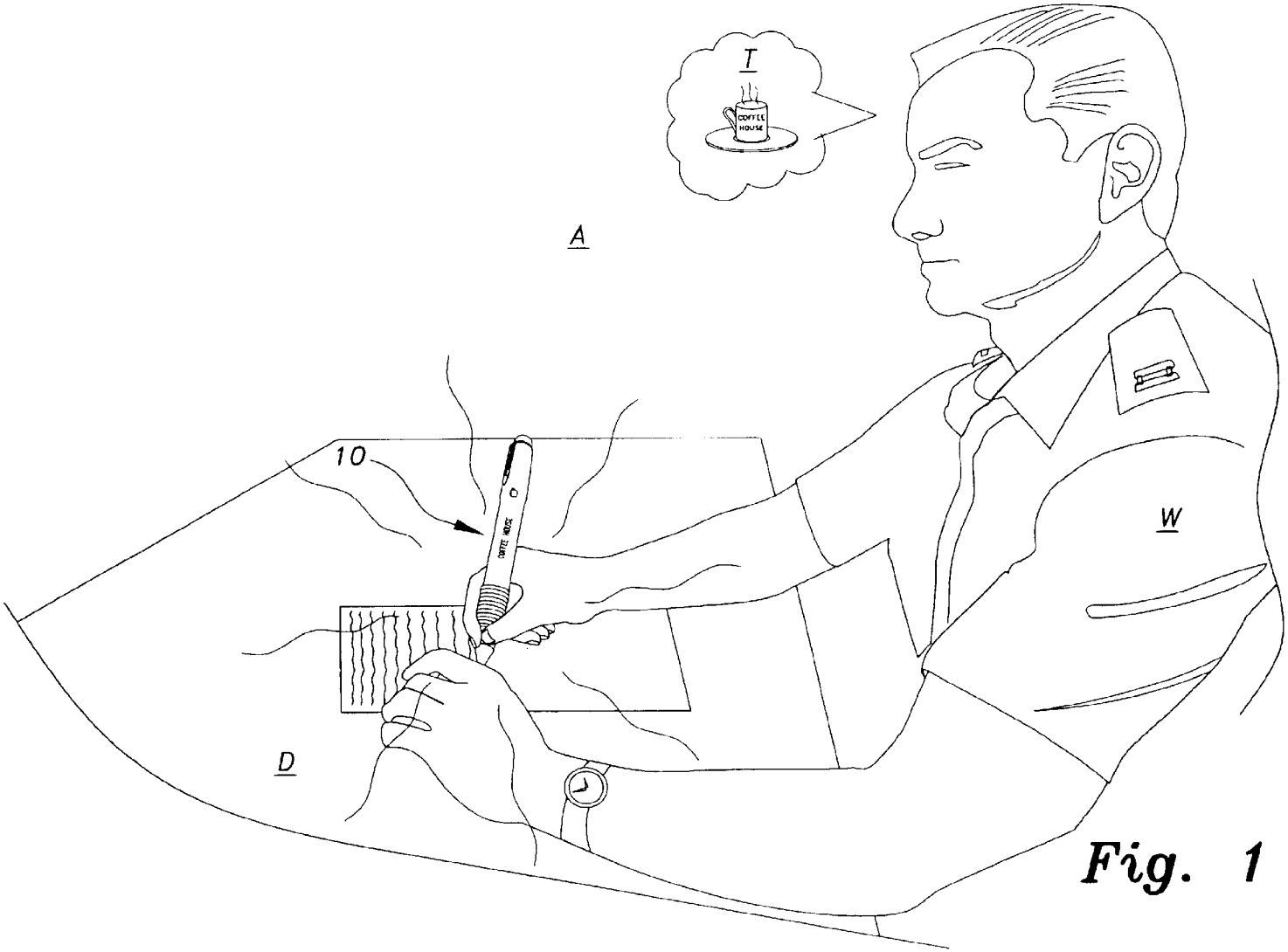
FIG. 1 is an environmental, perspective view of a pen with a scented housing and advertising according to the present invention.

Referring to FIG. 1, there is generally shown a scented pen 10 giving off the aroma similar to the nearby coffee house while the worker W is working at a desk D. As is illustrated, his thoughts T are diverted to the coffee house and a cup of their distinctive coffee as lunchtime approaches.

Figure 2:
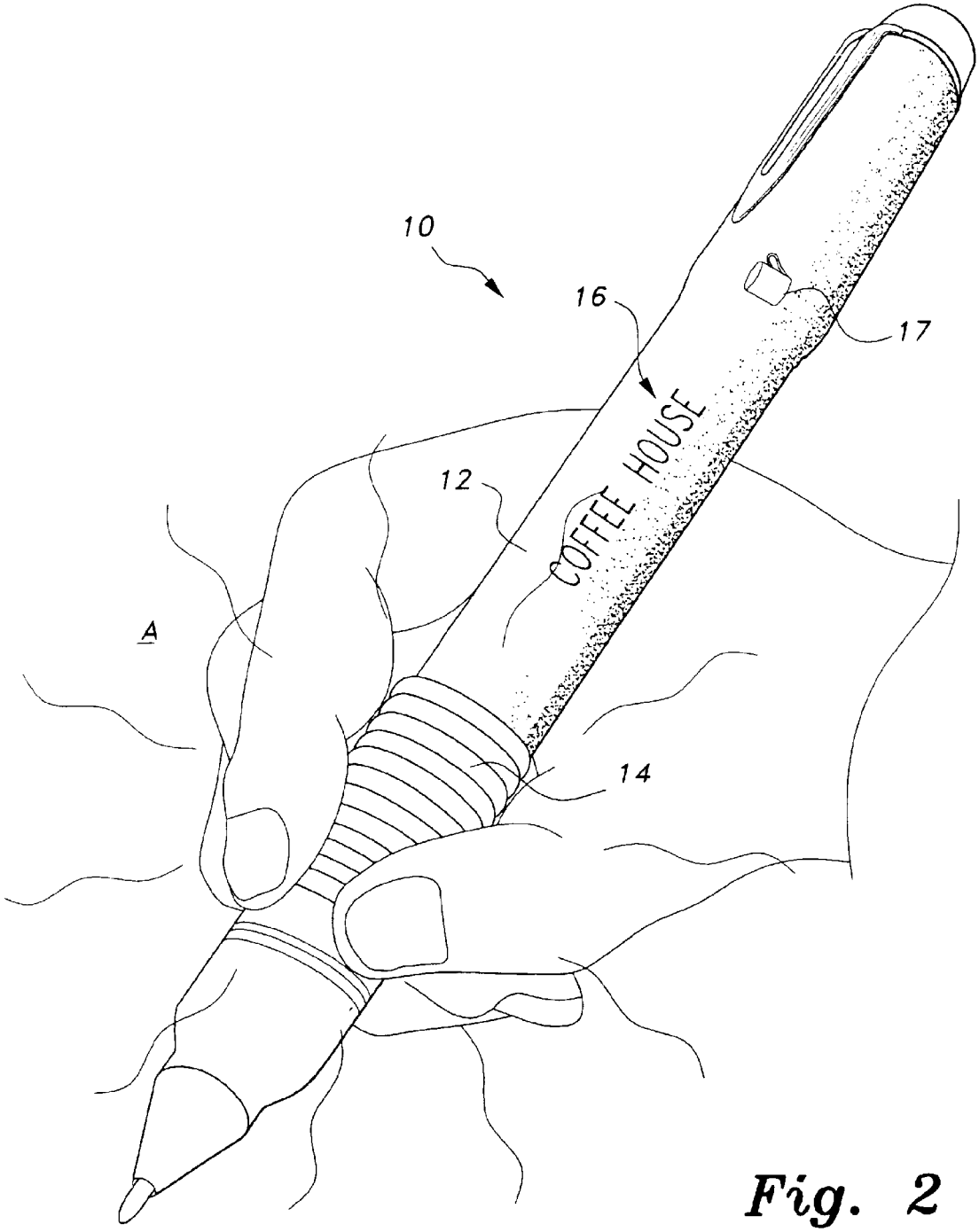
FIG. 2 is an environmental perspective view of a pen having a scented grip and advertising according to the present invention.
Figure 3:
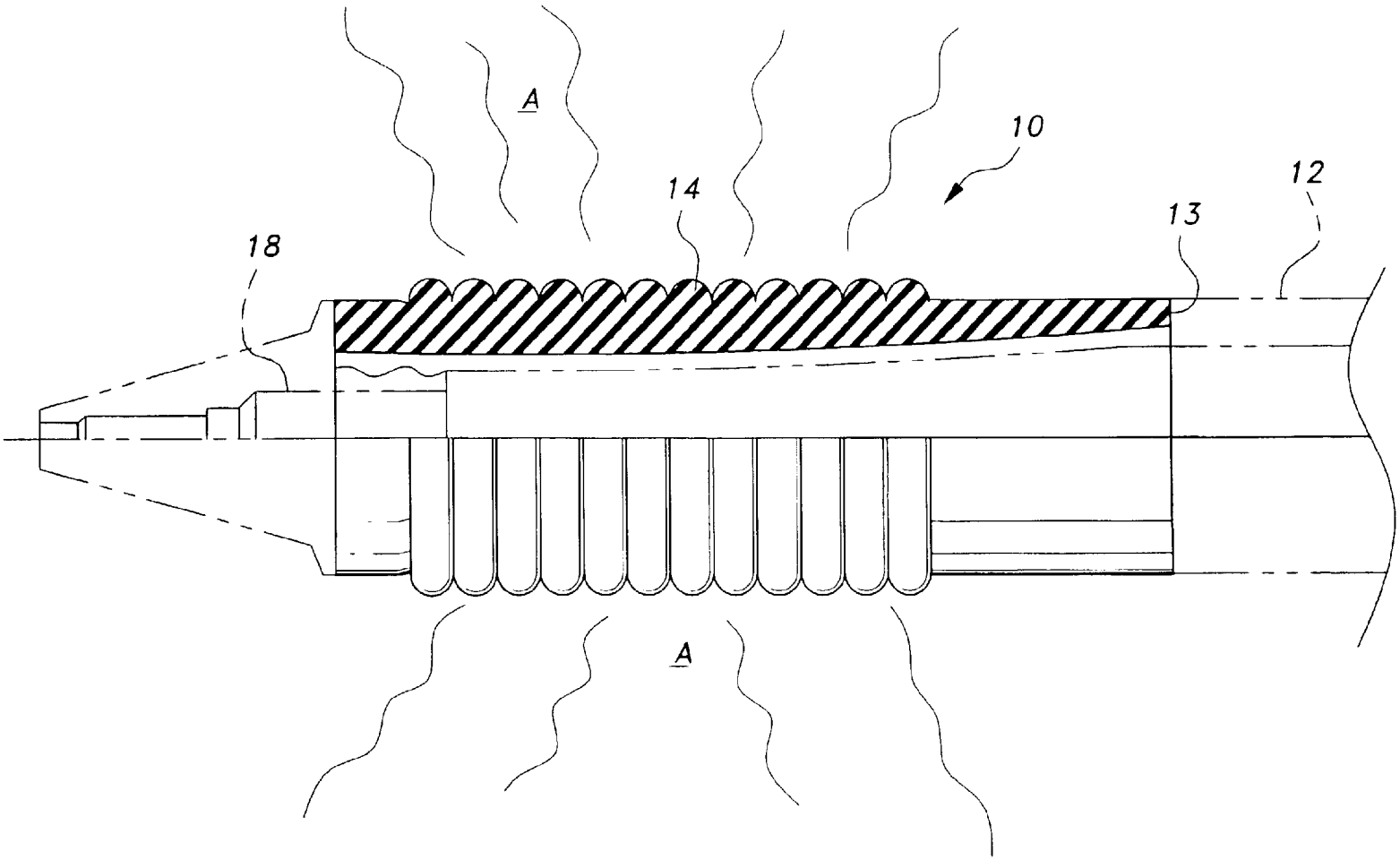
FIG. 3 is a quarter-section view of the pen of FIG. 2.

Referring to FIG. 2, there is shown an environmental perspective view of a pen 10 having a barrel 12 in which is incorporated a plastic polymeric or rubber grip 14, the grip giving off an aroma A associated with imprinted advertising 16 and logo 17 marked on the barrel 12 as in FIG. 1.

Figure 4:
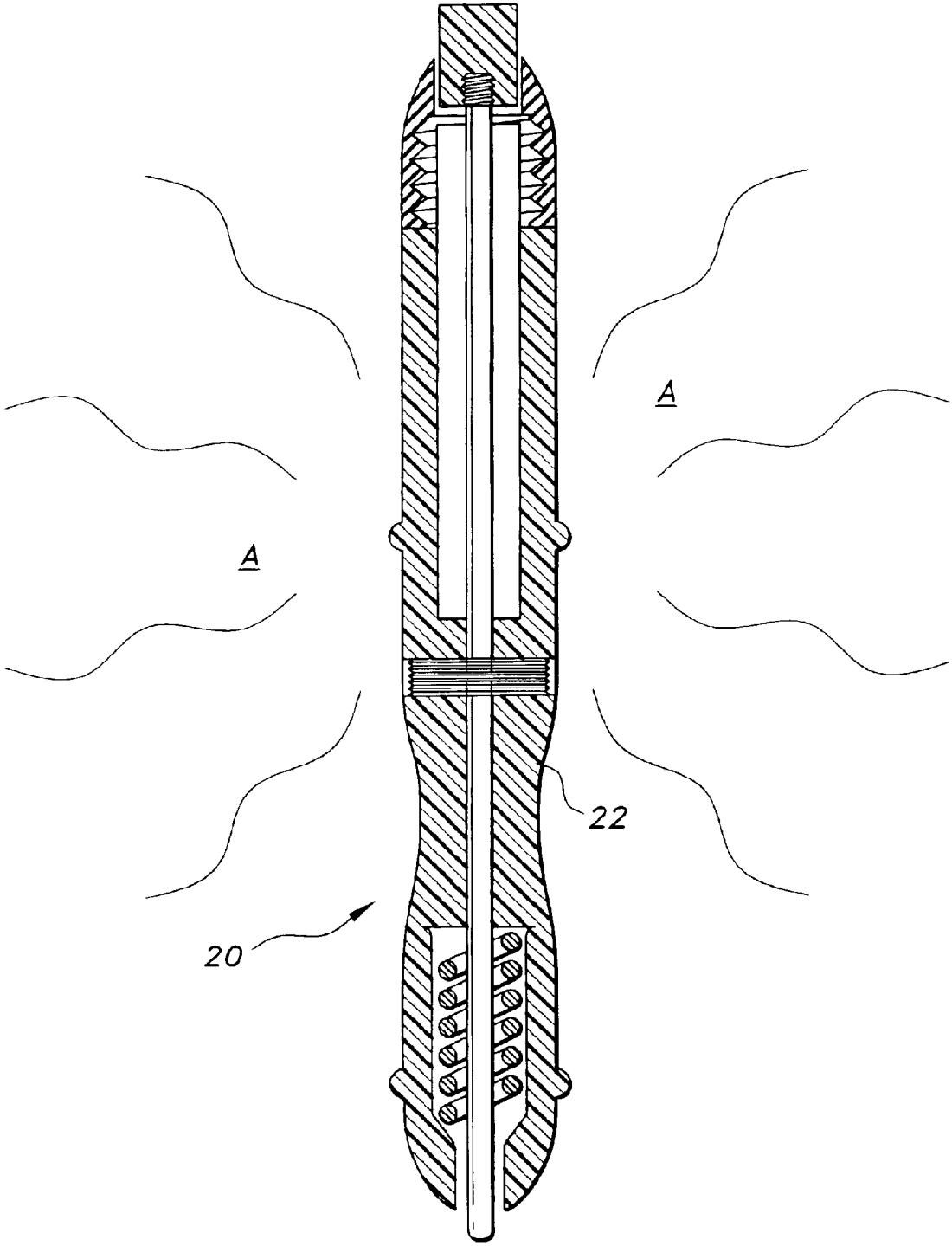
FIG. 4 is a section view of a pen having a scented plastic housing or barrel.

Referring to FIG. 4, there is shown a section view of a pen 20 having a scented plastic housing 22 which gives off a pleasant aroma A relating to advertising (not shown, see FIG. 2).

Figure 5:
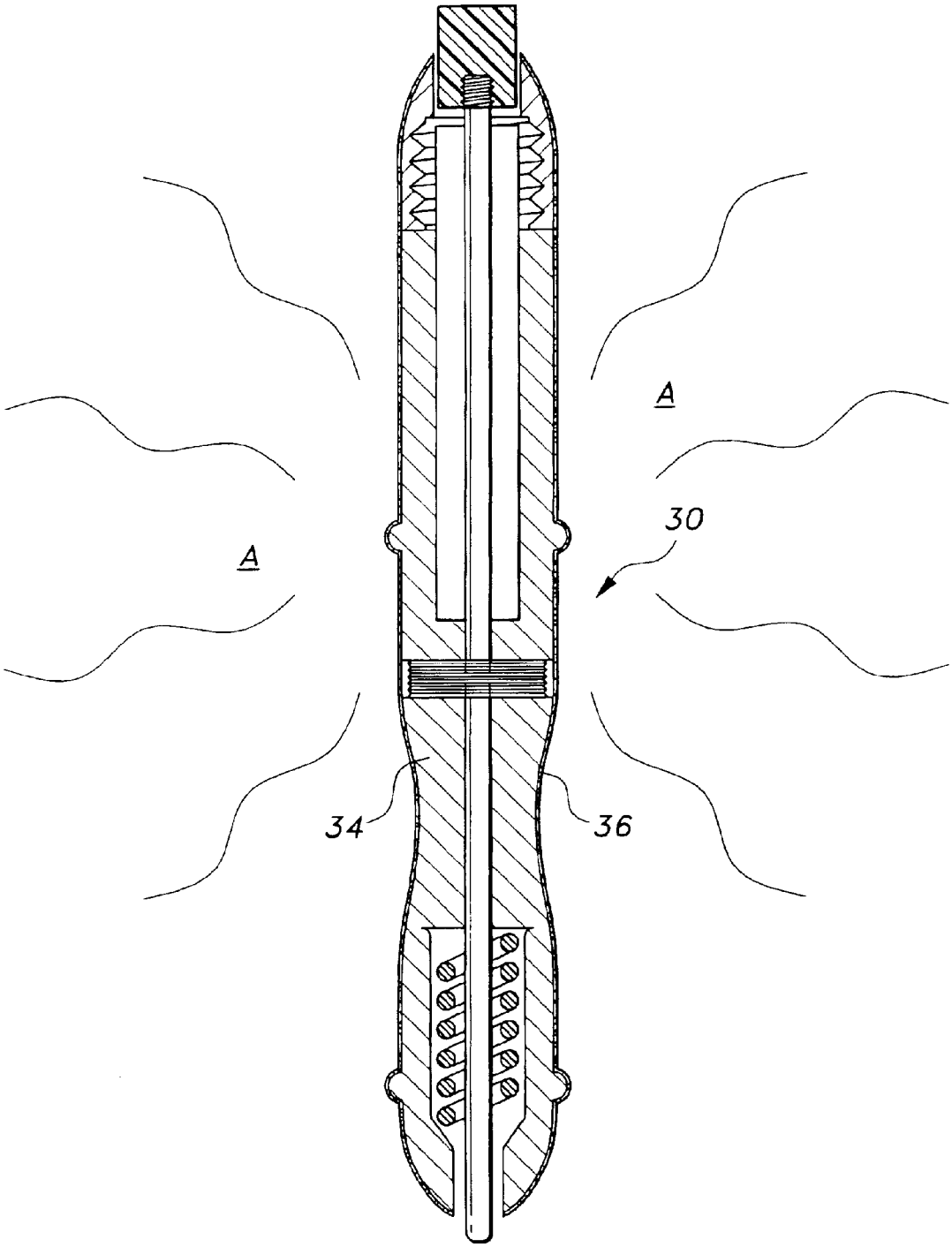
FIG. 5 is a section view of a pen having a housing or barrel with a scented coating.

Referring to FIG. 5, there is shown a section view of a pen 30 having a metal housing 34 with a scented coating 36 such as enamel, the coating giving off a pleasant aroma A related to imprinted advertising (not shown, see FIG. 2). A pen having a metal housing may be provided with a scented plastic grip made from scented compounds listed below.

The material of the scented housing may be of a molded plastic containing the aromatic oils and other liquids are slowly released as an aroma from the plastic such as described by C. Chen in U.S. Pat. No. 6,334,974 B1, issued Jan. 1, 2002, the disclosure of which is hereby incorporated by reference. In the case of a metal housing, a scented coating material may be employees such as described by Medri et al. in U.S. Pat. No. 5,110,584, the disclosure of which is hereby incorporated by reference.

Appropriate scented plastic compositions amenable to molding to obtain the desired pen housing shape are supplied, for example, by RTP Company, Winona, Minn. Fragrances including coffee and cappuccino, as well as a large variety of other fragrances are supplied compounded with olefinic resins such as polypropylenes, polyethylenes, and olefinic thermoplastic elastomers. Also available are scent-compounded plastics for personal care product, medical supplies and air freshening. These scented plastics can be injection molded, compression molded, extruded, or blow molded. Colors characteristic to the aroma can also be provided in the plastic composition.

Other component parts of various writing instruments may be scented by incorporation into their material of construction or by a scented coating include, for example, parts such as the tip, the barrel, the clip, the grip, the cap, the end cap, the click button, and the decorative ring. Not all pens have all the parts listed. The term "scented housing" is intended to include the scenting of one, several, or all component parts which comprise a writing instrument. It is intended that "pen" or "writing instrument" as used in this application includes roller ball, gel, and fountain pens having capped or retractable designs with a click or twist mechanism.

It is to be understood that the present invention is not limited to the embodiments described above, but encompasses any and all embodiments within the scope of the following claims.

We claim:

1. A pen for inducing a mental thought comprising:

a writing portion having a reservoir of ink, and an ink transferring point;

a barrel housing for receiving said writing portion internally;

wherein said housing is adapted to allow said ink transferring point to extend beyond externally thereof; and means for emanating an aroma from said housing, wherein said means for emanating is embedded in said barrel housing;

whereby the aroma is sensed and a thought associated with the aroma is generated in the mind of a user.

2. The pen according to claim 1, wherein said housing having an axial bore and two ends, said reservoir is disposed in said axial bore internally of the housing, and said ink transferring point extends externally from one of said ends.

3. The pen according to claim 1, said housing further including a retractor;

wherein said housing having an axial bore and two ends, said reservoir is disposed in said axial bore internally of the housing, and said refractor is disposed at one of said ends, and is coupled to said reservoir, said retractor moves said reservoir along said axial bore, such that said ink transferring point is moved through the other end of said housing so as to extend externally from said housing at said other end in a first position, and to retract internally in said housing.

4. The pen according to claim 1, further comprising indicia disposed on said housing for conveying a written message associated with the aroma.

* * * * *